United States Patent [19]

Kulp et al.

[11] Patent Number: 4,782,783

[45] Date of Patent: Nov. 8, 1988

[54] TRAFFIC CHANNELIZER MOUNTABLE VERTICAL PANEL

[76] Inventors: Jack H. Kulp; Carl L. Erwin, both of 16330 Phoebe Ave., La Mirada, Calif. 90637

[21] Appl. No.: 829,439

[22] Filed: Feb. 13, 1986

[51] Int. Cl.[4] ..... E01F 9/10

[52] U.S. Cl. ..... 116/63 P; 404/9

[58] Field of Search ..... 116/63 P, 63 R, DIG. 15, 116/DIG. 16; 340/114 R; 240/2; 40/609, 612; 256/1; 404/6, 9

[56] References Cited

U.S. PATENT DOCUMENTS

| | | | |
|---|---|---|---|
| 1,254,862 | 1/1918 | Strout | 116/63 P |
| 2,838,744 | 6/1958 | DeWald | 116/63 P |
| 2,843,347 | 7/1958 | King | 116/63 P |
| 3,056,377 | 10/1962 | Nelson | 116/63 P |
| 3,256,629 | 6/1966 | Whitman | 116/63 P |
| 3,740,881 | 6/1973 | Finger | 116/63 P |
| 3,880,406 | 4/1975 | Stehle et al. | 116/63 P |
| 4,004,545 | 1/1977 | O'Donnell | 116/63 P |
| 4,019,271 | 4/1977 | Latimer | 116/63 P |
| 4,083,033 | 4/1978 | Kulp | 116/63 P |
| 4,134,643 | 1/1979 | Lee | 116/63 P |
| 4,183,317 | 1/1980 | Follick | 116/63 P |
| 4,253,415 | 3/1981 | Ferch | 116/63 P |
| 4,674,432 | 6/1987 | Schmanski | 116/63 P |

*Primary Examiner*—William A. Cuchlinski, Jr.
*Assistant Examiner*—Thomas B. Will
*Attorney, Agent, or Firm*—Cohn, Powell & Hind

[57] ABSTRACT

A traffic channelizer mountable vertical panel molded of a resilient, impact resistant, plastic material. The vertical panel has a pair of mounting legs securable to the top of the traffic channelizer to permit the vertical panel area to extend above the channelizer. The legs are constructed so as to be bendable in response to wind forces without tipping over the channelizer and springing back to a vertical position when the bending forces subside.

17 Claims, 2 Drawing Sheets

TRAFFIC CHANNELIZER MOUNTABLE VERTICAL PANEL

FIELD OF INVENTION

This invention relates to traffic control devices and, more particularly, to a vertical traffic panel mountable to a traffic channelizer or the like.

BACKGROUND OF INVENTION

Heretofore vertical traffic control panels were mounted on a post attached to a concrete or steel base plate and were used as channelizing or warning devices. Traffic drums have been in use for a number of years as channelizing devices. Traffic channelizers were first used in the form of striped metal drums to function as a warning to motorists to indicate a defect or the like in a roadway that the motorist should avoid driving over. Stated differently, the traffic channelizer was to signal the motorist that if he was to impact the channelizer or to travel in the area adjacent the channelizer, he would be driving into an area that could cause great damage to him and his motor vehicle. This is unlike the function of a conventional traffic cone, which merely marks an area off which normally would not have a defect in the road, but merely to divert and control the flow of traffic. Traffic channelizers are also presently in use in which reflective surfaces are placed thereon so that the channelizer will be visible at night when illuminated by automobile headlights. Traffic channelizers have been introduced in recent years that are constructed of resilient plastic materials, and one commercially successful design is disclosed in the Kulp et al U.S. Pat. No. 4,083,033 granted on April 4, 1978. Plastic channelizers usually have a height of 36 inches and an 18-inch diameter, as dictated by the federal specifications for such traffic channelizers. These plastic channelizers may have reflective sheeting secured thereto in bands of different coloring, in accordance with governmental requirements. The reflective sheeting extends over the entire vertical surface of the channelizer, i.e., from the top to the bottom so that the channelizer will be more visible at night time. These traffic channelizers are also used with warning lights to further draw attention at night to the channelizer and the associated traffic hazard that is being signaled. The reflective sheeting that is presently used on traffic channelizers is subject to road splash or dirt and the like being thrown onto the reflective sheeting due to the motor vehicles traveling close by. The road splash causes the reflective sheeting on the channelizers to become dirty and difficult to see, particularly at night. This has been solved in the past by use of metal drums functioning as channelizers, by the user attaching a vertical support member to the metal drum, and then securing a vertical traffic warning panel to the vertical member. The vertical member may typically be a wooden piece of 2×4 that is secured to the metal drum and has a vertical panel on the order of 8 inches by 24 inches nailed to the vertical member for drawing attention to the location of the traffic channelizer. The panel area is generally provided with reflective material and/or reflective sheeting for obtaining the attention of the motorist, and particularly when the reflective properties of the traffic channelizer per se have become impaired due to road splash or the like. Accordingly, there is a present need for rendering traffic channelizers having reflective properties more visible to motorists by providing a readily available, vertically arranged reflecting means that is readily mountable on a traffic channelizer in a manner so that the vertical panel is not subject to road splash and thereby is maintained substantially clean and more visible for longer periods and does not require construction at the point of use.

SUMMARY OF INVENTION

The present invention provides an improved traffic channelizer mounted vertical panel that is sometimes referred to in the art as an "object marker" that may be readily secured to commercially available traffic channelizers. The vertical panel is advantageously molded from a resilient, impact resistant, plastic material so as to be economical to use without the necessity of construction at the point of use or requiring skilled labor to mount to a traffic channelizer. This soft, resilient, impact resistant vertical panel also reduces the damage to the vehicle and the vertical panel due to collision and is reuseable without major reconstruction. The improved vertical panel is constructed and defined to be responsive to bending forces impacting the panel, such as winds or wind gusts, without tipping over the channelizer proper and springing back to a substantially vertical position or traffic signaling position when the bending forces subside.

From a structural standpoint, the vertical panel of the present invention is adapted to be mounted on a traffic channelizer or the like wherein the vertical panel comprises a substantially flat panel area having a preselected width and a preselected height with leg means for securing the vertical panel to a traffic channelizer or the like adjacent the free ends of the leg means. The vertical panel is molded from a resilient, impact resistant, plastic material. The leg means are constructed and defined adjacent the attaching end to cause the vertical panel to have spring-like characteristics when secured to a traffic channelizer in response to wind forces or the like impacting the vertical panel. The leg means may comprise a pair of spaced legs adapted for securement to a traffic channelizer or the like adjacent each end of each leg. The legs are constructed and defined with a single wall thickness for a preselected length and then of a double wall construction merging into the flat panel area.

When used in combination with a traffic channelizer, the invention comprises a traffic channelizer having means for securing an object thereto arranged and constructed adjacent the top side of the traffic channelizer. The vertically extending panel means is secured to the traffic channelizing securing means and extending substantially vertically upwardly from the top side of the traffic channelizer. The panel means is constructed and defined with supporting leg means adapted to be secured adjacent one end of the leg means to the traffic channelizing securing means and a substantially flat panel area extending outwardly of the supporting leg means so as to extend substantially vertically above the leg means when the panel means and the traffic channelizer are secured at the channelizer securing means. The panel means is molded from a resilient, impact resistant, plastic material. The flat panel area for the panel means may be constructed and defined of a size for receiving reflecting, striped material thereon to aid in the visibility of the traffic channelizer.

BRIEF DESCRIPTION OF THE DRAWINGS

These and other features of the present invention may be more fully appreciated when considered in the light of the following specification and drawings, in which.

DETAILED DESCRIPTON OF THE PREFERRED EMBODIMENT

Figure 1:
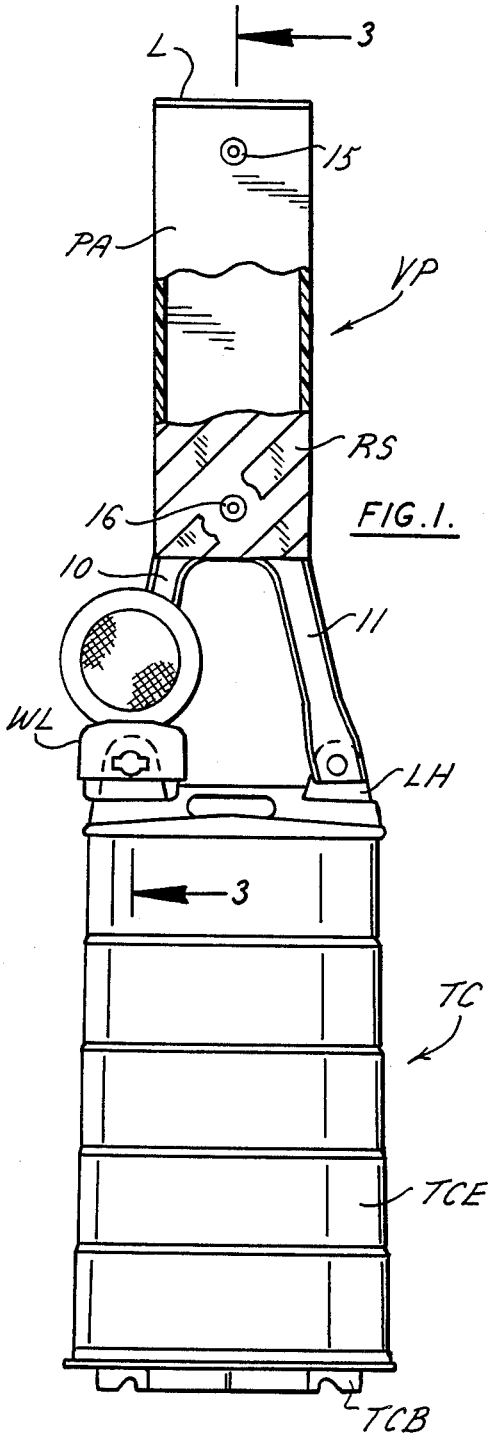
FIG. 1 is a front elevational view with a portion of the vertical panel broken away and with a portion bearing reflective material, and with a warning light secured to the traffic channelizer in combination with the vertical panel and embodying the present invention.
Figure 3:
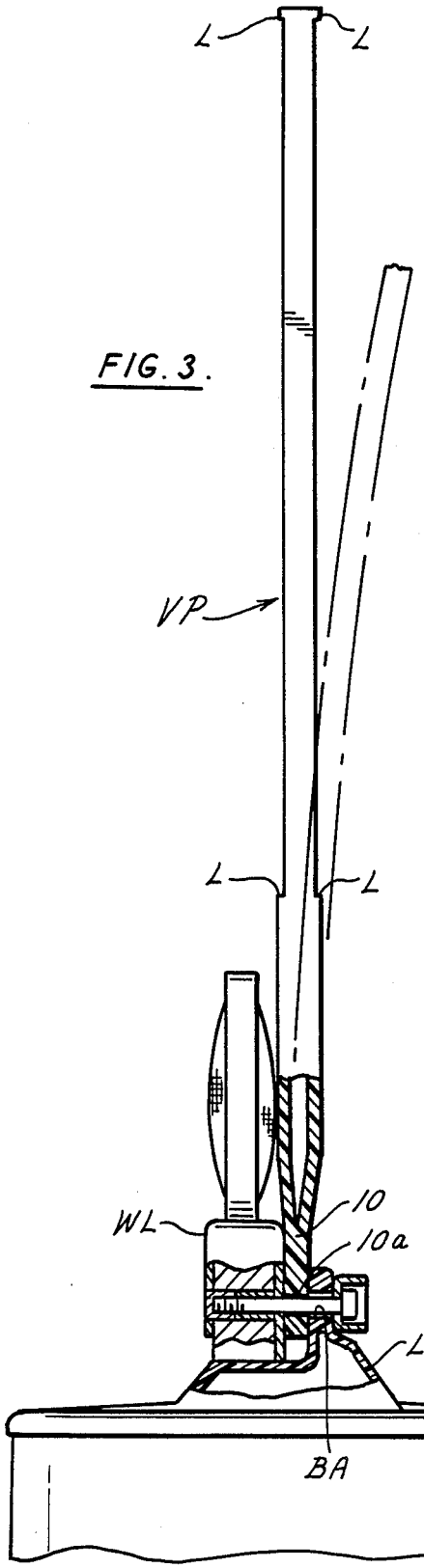
FIG. 3 is an enlarged, partial view of the top side of the traffic channelizer and with portions shown in section for illustrating the securement of the vertical panel and a warning light to the top of the traffic channelizer and with the bending movements of the vertical panel illustrated in dotted outline.

Now referring to the drawings, the traffic channelizer mountable vertical panel VP will be described in detail. The vertical panel VP is sometimes referred to in the art as an "object marker" but will be merely referred to herein as a vertical panel VP that is adapted to be mounted on a plastic traffic channelizer. Although there are a number of plastic traffic channelizers presently commercially available with which the vertical panel VP may be used, the vertical panel VP is particularly adapted to be mounted to the plastic traffic channelizer described and claimed in the co-pending patent application bearing Ser. No. 615,878 now U.S. Pat. No. 4,710,053 issued 12-1-87 and assigned to the same assignee as the present application. As noted in FIGS. 3–5*a* of said copending patent application, Ser. No. 615,878, now U.S. Pat. No. 4,710,053 the top of the traffic channelizer is particularly designed with a pair of spaced light holders LH or means for securing warning lights to the top of the traffic channelizer. Although it is not a requirement of the present invention, the traffic channelizer illustrated in the drawings is a two-piece traffic channelizer having a top portion TCE and a base TCB. The warning lights WL normally mounted on traffic channelizers are conventional barricade warning lights and are commercially available. The traffic channelizer TC and the warning lights WL illustrated in the drawings of the present application are commercially available from the Signal Division of Lear Siegler, Inc., located at 16330 Phoebe Ave., La Mirada, Calif. 90637. To facilitate the understanding of the present invention and the description thereof, the traffic channelizer TC disclosed in said co-pending application having the defined light holders LH for mounting the warning lights will be described with the vertical panel VP secured to the light holders LH with or without the warning light, as illustrated in FIGS. 1 and 3 hereof. A more detailed description of the traffic channelizer TC and the light holder LH may be had by reference to the co-pending application, Ser. No. 615,878, Now U.S. Pat. No. 4,710,053 and which disclosure is incorporated herein by reference. The light holders LH of the traffic channelizer TC are mounted at approximately 36 inches above ground level or the supporting surface. The vertical panel VP is approximately 24 inches in height and has a width of 8 inches to extend above the channelizer proper and to be readily visible to a motorist from both sides thereof.

Figure 2:
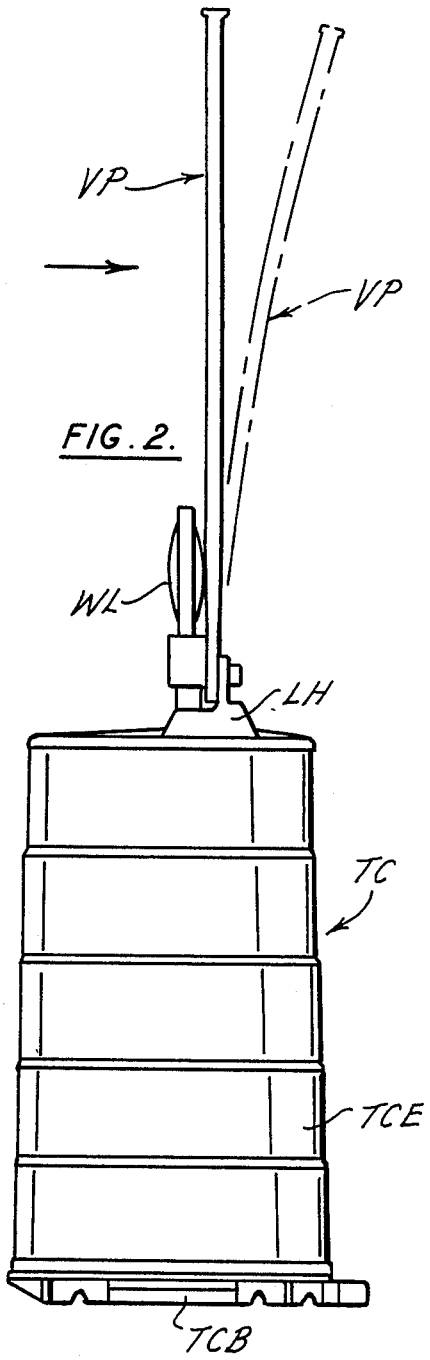
FIG. 2 is a side elevational view, viewed from the right hand side of FIG. 1, of the vertical panel mounted traffic channelizer, and indicating the bending of the vertical panel in dotted outline in response to forces impacting the vertical panel from the left hand side, as indicated by the arrow.

The vertical panel VP is illustrated in FIG. 1 mounted to the light holders LH for the traffic channelizer TC. The light holders LH are illustrated in FIG. 1 with a warning light WL secured to the left hand light holder and with no warning light secured to the right hand light holder LH, as illustrated in FIG. 1 and the remaining drawings. It will be recognized that the vertical panel VP may be attached to the light holders LH for the traffic channelizer TC either with one or two warning lights WL or without any warning lights WL. A single warning light WL is illustrated to show the relationship of the attachment of the vertical panel VP to the light holder LH and the light WL, as specifically illustrated in a cross-sectional portion of FIG. 3. A single fastening element, then, secures the vertical panel VP to the light holder LH and the warning light WL by taking advantage of the conventional construction of the housing for the warning light WL. It should be noted that the vertical panel VP is mounted on the same side of the light holder LH as the warning light WL, as is particularly evident from examining FIGS. 1–3, specifically between the upstanding portion of the light holder LH or the securing "ear" and the warning light WL. As illustrated in FIG. 3, the single fastening element may be an anti-theft fastening means. This specific construction of the warning light WL and the anti-theft fastening means are the same as described in the aforementioned co-pending application, Ser. No. 615,878, and may be more fully understood by reference to the aforementioned description in said co-pending application.

Figure 4:
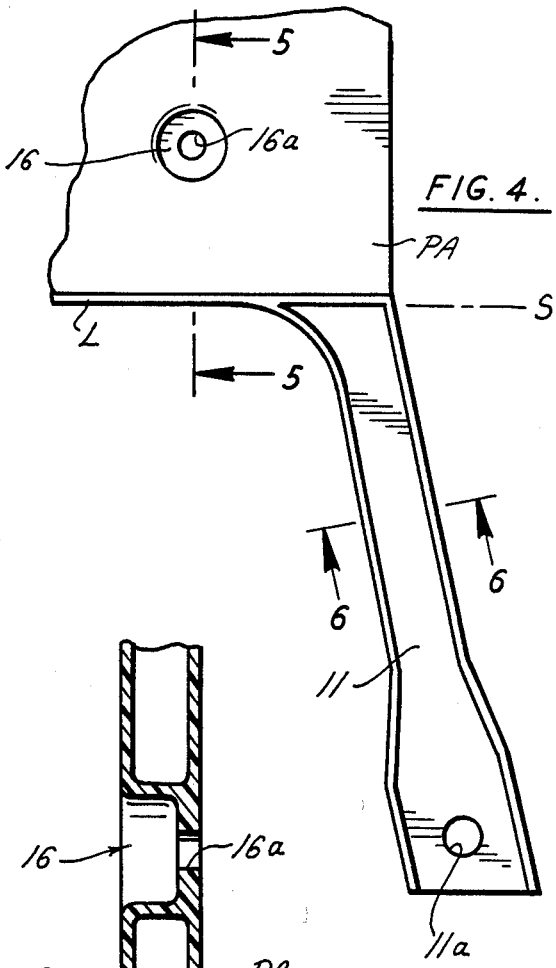
FIG. 4 is an enlarged, partial detail view of the arrangement of the legs for the vertical panel of the present invention.

Now referring to the vertical panel VP in particular, it will be seen that the panel is constructed with a flat panel area PA on both sides thereof with leg means dependent from the panel area for securing the vertical panel VP to the traffic channelizer TC. For this purpose, the leg means is illustrated as a pair of legs 10 and 11 dependent from the panel area PA and having free ends securable to the light holders LH of the traffic channelizer TC. The legs 10 and 11 are spaced in accordance with the spacing provided for the light holders LH on the traffic channelizer TC and extend angularly outwardly from the bottom portion of the panel area PA at a preselected angle, as illustrated. Each of the legs 10 and 11 has an aperture 10*a* and 11*a*, respectively, adjacent their free ends for securing the vertical panel VP to the corresponding apertures BA for the light holder LH; see FIG. 3. The vertical extension of the legs 10 and 11 is approximately 10½ inches from the centerline of the mounting apertures BA on the channelizer TC, with the panel area extending an additional 24 inches above the tops of the legs. The length of the legs and the height of the warning light holders above the top of the channelizer are such that the bottom of the reflecterized area of the panel is 48 inches from the ground or supporting surface. The vertical panel VP is molded from a plastic material and preferably a resilient, impact resistant material, such as a polyethylene plastic. The legs 10 and 11 are both constructed the same with a solid wall section adjacent the point of attachment and extending a preselected distance above the mounting apertures 10*a* and 11*a* and then flows into a double wall construction to the point of attachment at the panel area PA; see FIG. 3. The legs 10 and 11 have their opposite sides provided with a flat, paddle-like section so that they will bend due to forces impacting the panel, such as wind generated forces and the like. For this purpose, the single wall construction for the legs 10 and 11 is provided to render the mounted vertical panel VP bendable, as will be explained more fully hereinafter. The bending of the legs 10 and 11 will reduce the amount of force required to hold the panel in position atop the channelizer TC. The legs 10 and 11 are further defined so that the vertical panel VP will spring back to an upright position when the bending forces subside, such as the wind gusts. The paddle-like sections for the legs 10 and 11 are best illustrated in FIG. 4.

Figure 5:
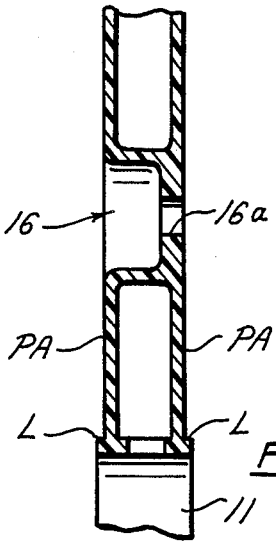
FIG. 5 is a partial sectional view of the panel taken along the line 5—5 of FIG. 4.
Figure 6:
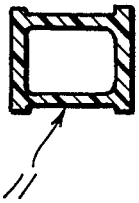
FIG. 6 is a sectional view taken along the line 6—6 of FIG. 4.

The flat panel area is approximately 1 inch thick and is recessed on the order of 0.030 inches for mounting commercially available reflective sheeting thereto. The bottom portion of the panel area illustrated in FIG. 1 is provided with such reflective sheeting RS. The top and bottom ends of the panel area are provided with a raised lip L to protect the sheeting during handling of the vertical panel VP and during use, including when the channelizer TC and vertical panel VP are impacted to the ground. It should also be noted that the panel areas of the vertical panel VP may be severed along the line S, as illustrated in FIG. 4, for severing the legs 10 and 11 when they are damaged and yet the panel area of the vertical panel VP will still be usable in a conventional fashion. This is accomplished by cutting off the legs 10 and 11 along the lines flush with the bottom edge of the panel area PA. The panel area PA can be used as a regular replacement for vertical panels of ordinary construction without the resilient mounting feature. For this purpose the panel area PA may be provided, as an option, with a pair of spaced mounting apertures 15 and 16. The mounting apertures 15 and 16 are arranged adjacent the ends of the vertical panel; see FIG. 1. The apertures 15 and 16 are both of the same construction, as illustrated in FIG. 5 for the mounting aperture 16. The walls of the panel area PA are of reduced thickness and have a fastening aperture 16*a* for receiving the shank of a bolt for securing the panel area to a support.

Now considering the vertical panel VP as being mounted on the traffic channelizer TC, an important aspect of the vertical panel is its ability to bend due to bending forces impacting the panel area PA or the legs 10 and 11 will now be described. The panel area PA encloses the hollow area defined by the panel area walls, as can be appreciated from viewing FIGS. 1 and 5. In the normal use of the mounted vertical panel VP, it will remain in a rigid relationship relative to the traffic channelizer TC and be maintained in this position during normal handling and wind forces. When a substantial wind exists or when substantial wind gusts are created, the vertical panel VP is designed so that it will bend or flex in response to such wind forces above a preselected force level. For this purpose the single wall construction at the attachment ends of the legs 10 and 11 (see FIG. 3) will permit the mounted vertical panel VP to flex about the mounted end of the vertical panel so that it will pivot or bend about the fastener to reduce the force that is required to hold the panel in position atop the channelizer and without tipping over the entire channelizer due to the wind forces. The construction is such that with a decrease in wind force or a subsiding of the wind force, the vertical panel VP will flex back to its normal vertical relationship with the channelizer. In conjunction with the bending action of the vertical panel VP of the present invention, the entire panel VP is molded from the desired polyethylene material so that the vertical panel, in conjunction with the traffic channelizer TC, will be able to withstand repeated impacts, such as when the traffic channelizer TC is impacted and the top portion of the channelizer TCE becomes separated from the base element TCB and impacts the ground. The plastic material and the construction of the vertical panel VP of the present invention will allow the vertical panel to take such repeated impacts with no appreciable damage to the vertical panel or to the impacting vehicle over the temperature ranges that are normally prevalent in highway or bridge construction zones throughout the country.

We claim:

1. In combination, a traffic channelizer having means for securing an object thereto arranged and constructed adjacent a top side of the traffic channelizer, a vertically extending reflecting means secured to said securing means and extending substantially vertically upward from the top side of the traffic channelizer, said reflecting means being constructed and defined with supporting means adapted to be secured to said securing means and having a reflective surface extending outwardly of the supporting means and extending substantially vertically above said supporting means when the supporting means and traffic channelizer are secured at said securing means, and said reflecting means being formed from a resilient, impact resistant, plastic material, the combination of traffic channelizer and reflecting means being constructed and defined to maintain the reflecting means in a substantially vertical position when secured to the traffic channelizer, the reflecting means including spring-like means responsive to wind forces applied to the reflecting means, the spring-like means reacting under wind forces without tipping the traffic channelizer.

2. In a combination as defined in claim 1 wherein said supporting means are constructed to be normally maintained in a substantially vertical position when secured to the traffic channelizer and yet sufficiently flexible to be responsive to bending forces of a pre-selected strength impacting the reflecting means to bend and to spring back to said vertical position when the bending forces are removed or reduced in strength.

3. In a combination as defined in claim 1 or 2 wherein said reflecting means is constructed and defined of a size for receiving reflecting, striped material thereon.

4. The device of claim 1 wherein said securing means includes a plurality of spaced apart fastening means, said fastening means being substantially vertically coplanar, and wherein said supporting means includes a plurality of spaced apart members, said members being substantially vertically coplanar and having means cooperating with said spaced apart fastening means to maintain said reflecting means in a hazard warning position when said fastening means and said members are connected.

5. In combination, a traffic channelizer having means for securing an object thereto arranged and constructed adjacent a top side of the traffic channelizer, a vertically extending panel means secured to said securing means and extending substantially vertically upwardly from the top side of the traffic channelizer, said panel means being constructed and defined with supporting leg means adapted to be secured adjacent one end of the leg means to said securing means and having a substantially flat panel area extending outwardly of the supporting leg means so as to extend substantially vertically above the leg means when the leg means and traffic channelizer are secured at said securing means, and said panel means being molded from a resilient, impact resistant, plastic material, the leg means being constructed and defined adjacent to said one end to be normally maintained in a substantially vertical position when secured to the traffic channelizer and yet sufficiently flexible to be responsive to bending forces of a pre-selected strength impacting the panel means to bend adjacent said one end, to be maintained on the channelizer, and to spring back to said vertical position when the bending forces are removed or reduced in strength, said securing means comprising a pair of spaced warning light securing means arranged on the top of the traffic channelizer and said leg means for the panel means comprising a pair of legs spaced for securement at the warning light securing means with at least one leg secured to at least one of the light securing means.

6. In a combination as defined in claim 5 wherein the flat panel area for said panel means is arranged on both sides of the panel means and selected to provide a reflective viewing area of a preselected width and height for attracting attention to the traffic channelizer to thereby control traffic.

7. In a combination as defined in claim 6 wherein each of said panel means legs is constructed and defined to have at least a portion of each leg to be flexible to bending forces of a preselected force applied thereto and to spring back upon the removal of the bending forces.

8. In a combination as defined in claim 5 wherein the warning light securing means and at least one of the legs of said panel means is secured at the securing means in combination with a warning light by a single fastening means.

9. In a combination as defined in claim 8 wherein said fastening means comprises anti-theft fastening means.

10. A traffic channelizer vertical object marker adapted to be mounted on a traffic channelizer, said vertical object marker comprising a vertically extending reflecting means having a preselected size and leg means for securing the vertical object marker to a traffic channelizer, adjacent one end thereof, the vertical object marker being a resilient, impact resistant, plastic material, the leg means being constructed and defined adjacent said one end to provide said vertical object marker with spring-like means, the spring-like means being responsive to wind forces applied to the vertical object marker, the spring-like means reacting under wind forces without transmitting tipping forces to said traffic channelizer, when connected therewith.

11. The device of claim 10 wherein the vertical object marker comprises a flat panel area.

12. A traffic vertical object marker adapted to be mounted on a traffic channelizer, said vertical object marker as defined in claim 11 wherein the leg means comprises a pair of spaced legs adapted for securement to said traffic channelizer adjacent one end of each leg, said legs being constructed and defined adjacent said one end of single wall thickness for a preselected length and then of a double walled construction to said flat panel area.

13. A traffic vertical object marker adapted to be mounted on a traffic channelizer, said vertical object marker as defined in claim 11 or 10 wherein said flat panel area is molded to have a preselected thickness with spaced walls on opposite sides thereof for defining substantially flat, object marker areas on the opposite sides of said vertical panel.

14. A traffic vertical object marker adapted to be mounted on a traffic channelizer, said vertical object marker as defined in claim 11 wherein the panel area is sized for securing reflective sheeting thereon.

15. A traffic vertical object marker adapted to be mounted on a traffic channelizer as defined in claim 14 wherein the panel area having reflective sheeting thereon has slight protective lips at opposite ends of the panel area.

16. A traffic vertical object marker adapted to be mounted on a traffic channelizer, as defined in claim 11 wherein said leg means are removable from the panel area to permit the vertical object marker to be secured to an object without the leg means.

17. A traffic vertical object marker adapted to be mounted on a traffic channelizer, as defined in claim 16 wherein the panel area is constructed and defined with aperture means for securement of the vertical object marker to an object at said aperture means.

* * * * *

UNITED STATES PATENT AND TRADEMARK OFFICE

CERTIFICATE OF CORRECTION

PATENT NO. : 4,782,783

DATED : November 8, 1988

INVENTOR(S) : Jack H. Kulp; Carl L. Erwin

It is certified that error appears in the above-identified patent and that said Letters Patent is hereby corrected as shown below:

Column 8, line 23, delete "10" and insert --12--.

Signed and Sealed this

Thirtieth Day of May, 1989

*Attest:*

DONALD J. QUIGG

*Attesting Officer*

*Commissioner of Patents and Trademarks*